US005928457A

United States Patent [19]

Engler

[11] Patent Number: 5,928,457

[45] Date of Patent: Jul. 27, 1999

[54] PROCESS FOR MAKING DECORATED NAILS

[76] Inventor: Michelle Engler, 11916 W. 109th St., No. 103, Overland Park, Kans. 66210

[21] Appl. No.: 09/017,345

[22] Filed: Feb. 2, 1998

[51] Int. Cl.[6] ..... A45D 29/00; A45D 31/00

[52] U.S. Cl. ..... 156/297; 132/73; 156/61; 206/581

[58] Field of Search ..... 132/73; 156/61, 156/299, 297; 206/581; 428/16, 542.6

[56] References Cited

U.S. PATENT DOCUMENTS

| | | | |
|---|---|---|---|
| 3,875,950 | 4/1975 | Gens | 132/73 X |
| 3,993,084 | 11/1976 | Cullen . | |
| 4,450,848 | 5/1984 | Ferrigno . | |
| 4,626,428 | 12/1986 | Weisberg . | |
| 4,898,192 | 2/1990 | Cohen . | |
| 4,903,840 | 2/1990 | So . | |
| 4,954,190 | 9/1990 | Taeckens . | |
| 5,133,369 | 7/1992 | Billings . | |
| 5,209,250 | 5/1993 | Taeckens . | |
| 5,778,900 | 7/1998 | Bate | 132/73 |

FOREIGN PATENT DOCUMENTS

| | | |
|---|---|---|
| 3337458 | 4/1985 | Germany . |

*Primary Examiner*—Jeff H. Aftergut
*Attorney, Agent, or Firm*—Chase & Yakimo, L.C.

[57] ABSTRACT

Decorated nails and methods therefor preferably using tissue paper and metallic foils. Crumbled pieces of metallic foil or pieces of tissue paper are mixed with a substantially clear polish and applied to a nail with the pieces in an overlapping relationship or immediately adjacent one another to present a textured or stained-glass effect, respectively. Alternatively, a thin layer of a metallic foil or tissue paper may be affixed to the nail over an adhesive layer. A substantially clear top sealing layer is applied over the decorated nail.

6 Claims, 2 Drawing Sheets

PROCESS FOR MAKING DECORATED NAILS

FIELD OF THE INVENTION

Generally, this invention relates to a method of nail decorating. More specifically, the invention relates to the application of metal foils, tissue paper and other ornamental designs to artificial or natural nails.

BACKGROUND OF THE INVENTION

The treatment of fingernails is an extremely large business. Numerous types of artificial nails are known: plastic and cloth materials are used for nail extensions and to cover an entire nail. Also, polishes and other finishing materials are known for obtaining attractive and unique nail appearances.

However, nail decorating can be expensive, messy and very time consuming. Often professional manicurists must be employed. Polish typically chips and peels, eventually requiring reapplication whether on natural or artificial nails. Furthermore, application of a plurality of colors of polish to a single nail as well as achieving a textured look is very difficult.

SUMMARY OF THE INVENTION

Accordingly, a primary object of the subject invention is to provide a method of decorating natural and artificial nails using ornamental foils or tissue paper.

Another object of the subject invention is to provide a method of decorating nails in a plurality of colors and textures.

Another object of the subject invention is to provide a method of decorating nails that is difficult to chip or peel.

Yet another object of the subject invention is to provide a method of decorating nails that is easy and not too time consuming.

Still another object of the subject invention is to provide decorated nails and a method therefor that can be done at home, relatively inexpensively.

These objects may be attained by mixing crumbled pieces of metallic foil or other desirable ornamentation with a substantially clear polish, applying the foil/polish mixture over at least a portion of a nail with the pieces preferably being either in an overlapping relationship or immediately adjacent one another to present a textured decorative layer of foil (hereinafter referred to as nuggeting). The foil layer is coated with a clear polish to help seal and secure the foil layer.

These objects may also be attained by coating at least a portion of a nail with an adhesive, affixing a thin ornamental paper-like layer over the adhesive and applying a substantially clear nail polish over the ornamental layer. The ornamental layer is preferably either formed of tissue paper pieces affixed in an overlapping relationship or immediately adjacent one another to create a stained glass, textured appearance (hereinafter referred to as the decoupage technique) or is formed of a smooth piece of thin metallic foil for a shiny, smooth appearance (hereinafter referred to as gilding).

Any combination of these techniques may be used on each nail to create a strong set of nails having a variety of appearances and textures.

DETAILED DESCRIPTION

Fingernail 10, as in FIGS. 1–9, is decorated using the nuggeting (FIGS. 1–3), gilding (FIGS. 4–5) and decoupage (FIGS. 6–7) techniques described in detail herein. Fingernail 10 is shown as a natural nail; however, fingernail 10 may also be any type of artificial nail or nail tip or extension. Also, although the nail decorating techniques are discussed herein with reference to fingernails, it should be understood that the same may also apply to toenails.

Figure 1:
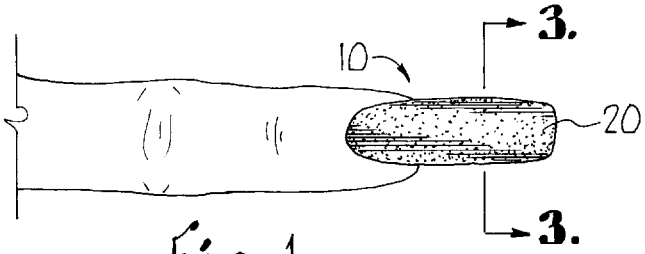
FIG. 1 is a top view of a fingernail decorated in accordance with the present invention showing the effect of nuggeting.
Figure 3:
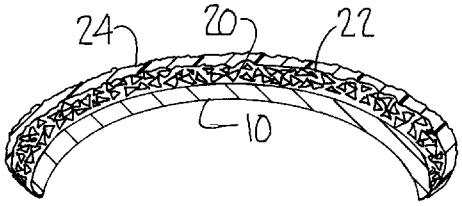
FIG. 3 is a cross-sectional view along line 3—3 of FIG. 1.
Figure 2:
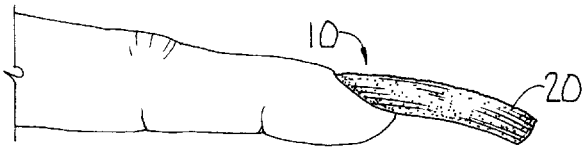
FIG. 2 is a side view of FIG. 1.

Nail 10 is decorated using the nuggeting technique, as seen in FIGS. 1–3. Nuggeting is accomplished by mixing crumbled pieces 20 of metallic foil or leaf or other ornamental pieces with a conventional clear or colored polish. A layer 22 of this foil and polish mixture is applied to nail 10 with a brush and allowed to dry.

Preferably, the crumbled pieces 20 are applied in either an overlapping relationship or immediately adjacent one another, with no spaces therebetween. Thus, a substantial amount of the crumbled pieces 20 are mixed with the polish, and layer 22 presents a continuous textured layer of crumbled foil 20 over the top surface of nail 10.

A clear top coat 24 of sealer or polish is applied over layer 22 to help prevent cracking and peeling thereof.

As shown in FIGS. 1–3, the entire top surface of nail 10 has been nuggeted. Alternatively, only a portion thereof may be so decorated, as desired. Also, a variety of colors of foil may be mixed to create a multi-colored layer 22, such as gold and silver leaf.

Figure 4:
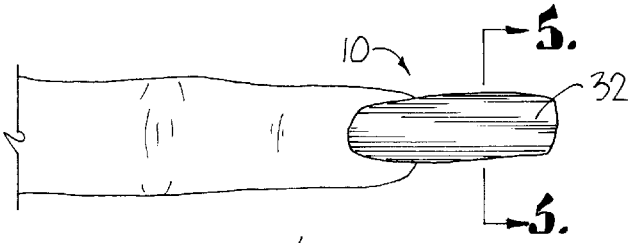
FIG. 4 is a top view of the fingernail of FIG. 1 but decorated using the gilding technique.
Figure 5:
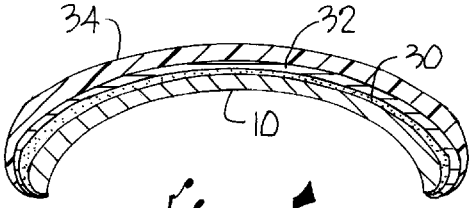
FIG. 5 is a cross-sectional view along line 5—5 of FIG. 4.

Nail 10 is decorated using the gilding technique as seen in FIGS. 4–5. Gilding is accomplished by applying an adhesive coating 30 over the top surface of nail 10 with a brush, adhering a thin sheet material 32 over coating 30 and brushing a top layer 34 of clear polish or other sealer over the sheet material 32. One type of adhesive coating that may be used is Old World Art gold leaf adhesive size, #802. Upon application to the nail 10, this adhesive is milky white. It should be allowed to dry clear, leaving a sticky film over which the sheet material 32 is applied.

The sheet material 32 is adhered to the adhesive coating by gently pressing a piece of the material 32 having an area larger than the nail, over the nail 10, trimming the excess material 32 that extends beyond the periphery of nail 10 and smoothing the material 32 with a brush, by brushing the edges of the nail, the end of the nail and around the cuticle. Preferably, the thin sheet material 32 is aluminum, silver, copper, gold or other metallic leafing material. Upon its application to the nail, it creates a smooth, shiny appearance that adds strength to the nail and does not crack or chip easily. As shown in FIGS. 4 and 5, the thin sheet material 32 is applied over the entire outer surface of the nail 10; however, it may be applied over a portion thereof, as desired.

One or more top coats 34 may be applied. To maintain the decorated nail's durability, a clear top coat 34 may be applied approximately every two days.

Figure 6:
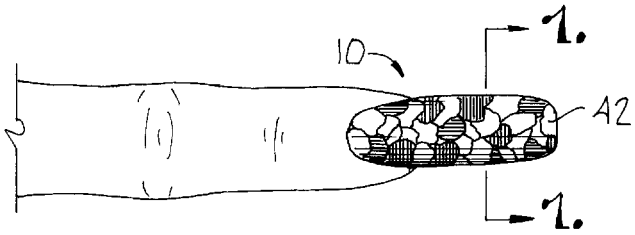
FIG. 6 is a top view of the fingernail of FIG. 1 but decorated using the decoupage technique.
Figure 7:
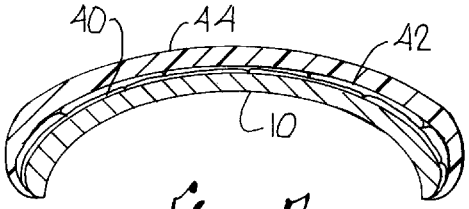
FIG. 7 is a cross-sectional view along line 7—7 of FIG. 6.

The decoupage technique for decorating nail 10 is shown in FIGS. 6–7. Decoupage is accomplished by applying an adhesive coating 40 over the top surface of nail 10 and placing crumbled, torn pieces of colored tissue paper 42 over the adhesive 40. Plaid Royal Coat decoupage sizing may be used as the adhesive. Preferably, the tissue paper is applied over the adhesive coating 40 before it dries, working from the cuticle, outwardly to the nail tip. The tissue pieces 42 form a layer over the adhesive 40 by being placed randomly over the nail surface in an overlapping but immediately adjacent relationship. When the adhesive layer 40 is dry, a top coat 44 is applied over the tissue paper layer 42, preferably consisting of a substantially clear nail polish or other sealer to help prevent cracking and chipping thereof.

This technique creates a textured, stained-glass effect. Ornamentation other than tissue paper may be used, such as stars, moons, angels and any other designs; however, they should be placed in an overlapping relationship to help increase the strength of the nail 10.

Figure 8:
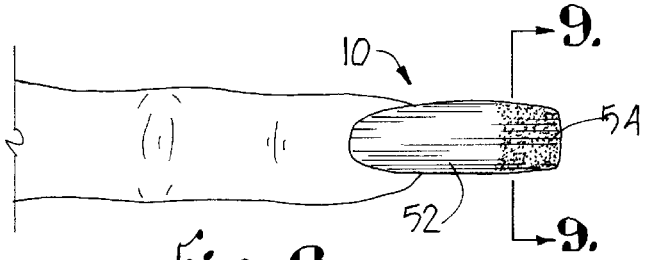
FIG. 8 is a top view of the fingernail of FIG. 1 but decorated using the gilding and nuggeting techniques together.
Figure 9:
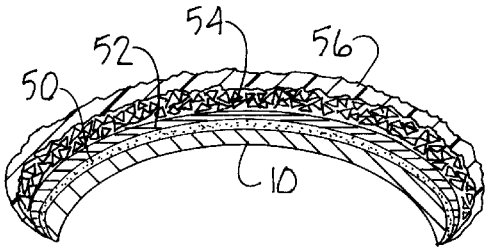
FIG. 9 is a cross-sectional view along line 9—9 of FIG. 8.

FIGS. 8 and 9 show nail 10 decorated using a combination of the gilding and nuggeting techniques. As shown, the entire top surface of the nail 10 has been gilded (as in FIGS. 4–5). Over the gilding, the nail tip is decorated using the nuggeting technique (as in FIGS. 1–3). Thus, a cross-section through the nail tip as in FIG. 9 includes an adhesive layer 50, over which a smooth metallic leaf layer 52 is adhered to achieve the gilded effect. The nuggeting is applied over the leaf layer 52 and includes a crumbled foil and polish layer 54 and a sealer layer 56 as discussed in detail above.

Thus, nail 10 decorated using any of these technique is strong and durable. Furthermore, these decorating techniques, unlike standard polishes, are less susceptible to cracking and chipping and do not require the upkeep of other decorated nails.

Having thus described the invention, what is claimed as new and desired to be secured by letters patent is as follows:

1. Nail decorating, comprising the steps of:

coating a nail with an adhesive;

affixing torn tissue paper pieces in an arbitrary arrangement over the adhesive with the pieces being either in an overlapping relationship or immediately adjacent another piece to form a continuous layer of tissue paper on the nail and present a stained glass effect;

applying a substantially clear nail polish over the tissue paper pieces.

2. Nail decorating, comprising the steps of:

applying a sticky adhesive over a portion of the nail, the nail adhesive being sticky even when dry;

allowing the adhesive to dry;

affixing a continuous metal foil layer to the portion of the nail having the sticky adhesive thereon;

coating the metal foil layer with a clear polish;

applying another adhesive over a portion of the nail;

affixing torn tissue paper pieces over the another adhesive, with the pieces being either in an overlapping relationship or immediately adjacent another piece;

applying a substantially clear coat of nail polish over the tissue paper pieces.

3. Nail decorating as claimed in claim 2 wherein said sticky adhesive is a sizing.

4. Nail decorating as claimed in claim 2 wherein said another adhesive is a decoupage glue.

5. Nail decorating as claimed in claim 2 wherein said metal foil layer is a single piece of metal foil.

6. Nail decorating, comprising the steps of:

first applying a sticky adhesive over the nail, the nail adhesive being sticky even when dry and allowing the adhesive to dry;

applying a metal foil over the dry, sticky adhesive and removing any remaining excess metal foil extending beyond the nail;

next, applying a second adhesive over at least a portion of the metal foil layer;

applying tissue paper pieces to the portion of the nail having the second adhesive thereon, with the pieces being either in an overlapping relationship or immediately adjacent another piece;

applying a substantially clear coat of nail polish over the nail.

* * * * *